US005135433A

United States Patent [19]

Watanabe et al.

[11] Patent Number: 5,135,433

[45] Date of Patent: Aug. 4, 1992

[54] COIN SORTING APPARATUS

[75] Inventors: Kenkichi Watanabe, Kawasaki; Hideshi Sentoku, Tokyo, both of Japan

[73] Assignee: Laurel Bank Machines Co., Ltd., Tokyo, Japan

[21] Appl. No.: 742,337

[22] Filed: Aug. 8, 1991

[30] Foreign Application Priority Data

Aug. 10, 1990 [JP] Japan ..... 2-212947

[51] Int. Cl.[5] ..... G07D 3/14

[52] U.S. Cl. ..... 453/3; 453/56; 194/346

[58] Field of Search ..... 453/3, 7, 11, 56; 194/346

[56] References Cited

U.S. PATENT DOCUMENTS 4,558,712 12/1985 Sentoku et al. ..... 453/3

FOREIGN PATENT DOCUMENTS 0340501 11/1989 European Pat. Off. ..... 453/7
3924199 1/1990 Fed. Rep. of Germany ..... 453/11
59-172090 9/1984 Japan .
2-18182 2/1990 Japan .
2-93994 4/1990 Japan ..... 453/3

*Primary Examiner*—F. J. Bartuska
*Attorney, Agent, or Firm*—Fleit, Jacobson, Cohn, Price, Holman & Stern

[57] ABSTRACT

The invention provides an apparatus for separating one specified kind of coins from a plurality of coins including various kinds of coins. To this end, a coin sorting apparatus in accordance with the invention is characterized by a sort-out opening formed on a surface of a coin guideway downstream with respect to a coin identifying device; a rotor having an axis about which the rotor is rotatable, which rotor having a larger diameter portion having elevation equal to or slightly higher than the coin guideway and a smaller diameter portion having elevation lower than the coin guideway, the axis lying substantially beneath the center of the sort-out opening and under the coin guideway, the axis parallel to the coin guideway and normal to the coin feeding direction; and a controller for controlling the rotation of the rotor so that the larger diameter portion of the rotor aligns with the coin guideway when coins belonging to a first group are fed to the sort-out opening and the smaller diameter portion of the rotor forms a gap between the rotor and the coin guideway when coins belonging to a second group are fed to the sort-out opening.

20 Claims, 5 Drawing Sheets

FIG. 3

| No. | FIRST SIGNAL ARRAY | SECOND SIGNAL ARRAY (17a) | POSITION OF ROTOR 10a | SECOND SIGNAL ARRAY (17b) | POSITION OF ROTOR 10b |
|---|---|---|---|---|---|
| 1 | ¥100 | ○ | FIRST | ○ | SECOND |
| 2 | ¥10 | ○ | FIRST | ○ | FIRST |
| 3 | FOREIGN COIN | ○ | SECOND | × | × |
| 4 | ¥50 | ○ | FIRST | ○ | FIRST |
| 5 | ¥1 | ○ | FIRST | ○ | FIRST |
| 6 | ¥100 | ○ | FIRST | ○ | SECOND |
| 7 | ¥100 | ○ | FIRST | ⋮ | ⋮ |
| 8 | ¥5 | ⋮ | ⋮ | ⋮ | ⋮ |
| ⋮ | ⋮ | ⋮ | ⋮ | ⋮ | ⋮ |

COIN SORTING APPARATUS

FIELD OF THE INVENTION

The present invention relates to an apparatus for sorting coins by determining the face value of coins and examining the genuineness of coins and dropping coins through a sort-out opening other than those of the determination it is desired to retain.

PRIOR ART

Two types of coin sorting apparatus are conventionally and mainly used. One measures outer diameters of coins in order to drop undesired coins into an opening in accordance with the outer diameters so as to retain desired coins, the other determines the face values of coins by means of a suitable identifying means, such as means for measuring outer diameters of coins or means for detecting alloy of coins, and accordingly controls a gate at an opening for dropping other coins thereinto than those desired to retain so as to sort coins( for instance, see Japanese Patent Public Disclosure No. 59-172090 and Utility Model Public Disclosure No. 2-18182).

In an apparatus for sorting coins by measuring outer diameters of coins, it is difficult to correctly sort coins if they have only slight differences in the outer diameters thereof. In addition, in this apparatus, coins are usually sorted disadvantageously in the order from larger to smaller diameters of coins or in the converse order.

On the other hand, in the apparatus for sorting coins by controlling a gate, as far as the gate is appropriately controlled to open or close, coins are correctly sorted without failure. Furthermore, this apparatus can sort coins advantageously depending on the face values thereof in any order the operator desires. However, since this apparatus operates a gate to sort coins, exact timing of opening or closing of the gate is required to avoid jamming and incorrectly sorting coins. For this end, it is necessary to feed coins with a predetermined separation therebetween in order to operate the gate appropriately. Accordingly, this apparatus has the problem that the feeding speed cannot be increased over a specific speed.

In the gate device for sorting coins disclosed in Japanese Public Disclosure No. 59-172090, in particular FIGS. 7 and 8, a gate is provided in a sort-out opening formed on a coin guideway. This gate is arranged to be rotatable up and down about an axis disposed at the end of the sort-out opening, which end is disposed at the downstream in the coin feeding direction. When the gate is situated in the plane defined by the coin guideway, coins being fed pass on the top surface of the gate, while when the gate rotates upward and stays there, coins being fed fall into the sort-out opening as guided downward by the bottom surface of the gate. Thus, coins are separated into two groups depending on the face values.

However, this gate system has problems as described hereinafter. For instance, suppose that coins are fed continuously, and that a first fed coin is intended to pass on the top surface of the gate and a following fed coin is intended to guide into the sort-out opening along the bottom surface of the gate. In this case, though the gate is intended to drive upward for guiding the following fed coin into the sort-out opening, it is not possible to drive the gate upward since the first fed coin is being fed on the top surface of the gate and is being pressed against the top surface by the coin feeding belt. Accordingly, it is not possible to drop the following fed coin through the sort-out opening. Next, suppose that a first fed coin is intended to be guided into the sort-out opening along the bottom surface of the gate and a following fed coin is intended to pass on the top surface of the gate. In this case, the gate is kept upward to guide the first fed coin into the sort-out opening. Then, when the gate is driven downward for passing the following fed coin on the top surface of the gate, if the timing of driving the gate downward is too early, the rear end of the first fed coin may be interposed between the tip end of the gate and the sort-out opening since the first fed coin is being fed under the bottom surface of the gate. Thus, it causes coin jamming. On the other hand, if the timing of driving the gate downward is too late, the following fed coin as well as the first fed coin is introduced into the sort-out opening. This also causes coin jamming because the forward portion of the following fed coin may be clamped between the tip end of the gate and the sort-out opening.

Such coin jamming is caused by the fact that the gate is pivoted so that a locus of the gate intersects the coin guideway. Therefore, the gate system in which the locus of the gate does not intersect the coin guideway while the gate is pivotting is suggested, for instance in Japanese Utility Model Public Disclosure 2-18182, in particular FIG. 12.

In this gate system, a sort-out opening is provided on a coin guideway and a gate is provided in the sort-out opening. The gate is arranged to be rotatable up and down about an axis disposed at the end of the sort-out opening, which end is disposed upstream with respect to the coin feeding direction. When the gate is in its first position wherein the gate lies in a plane defined by the coin guideway, coins fed pass over the top surface of the gate. When the gate is in its second position wherein the downstream portion of the gate descends under the coin guideway, coins fed slides down along the top surface of the gate into the sort-out opening. Thus, coins fed are separated into two groups.

This gate system has advantages over the aforementioned gate system since the locus of the gate does not intersect the coin guideway. For instance, suppose that two or more coins are continuously fed and that a first fed coin is intended to pass the top surface of the gate disposed in its first position and a following fed coin is intended to fall into a sort-out opening along the top surface of the gate disposed in its second position. If the first fed coin has passed most of the sort-out opening, it is advantageously possible to drop the following fed coin into the sort-out opening along the top surface of the gate without the first fed coin dropping into the sort-out opening, even if the gate moves to the second position, since the coin is pressed with a certain force against the coin guideway by the coin feeding belt.

On the other hand, suppose that the first fed coin is intended to fall into the sort-out opening and the following fed coin is intended to pass over the sort-out opening on the top surface of the gate. In this case, when the gate is driven to pivot upward for passing the following fed coin over the sort-out opening on the top surface of the gate, the first fed coin is sliding down along the top surface of the gate. Therefore, if the timing of driving the gate upward is too early, the rear portion of the first fed coin is clamped between the tip end of the gate and the sort-out opening. This causes coin jamming.

On the other hand, if the timing of driving the gate upward is too late, the following fed coin as well as the first fed coin is introduced into the sort-out opening, so that the forward portion of the following fed coin is clamped between the tip end of the gate and the sort-out opening. This also causes coin jamming.

As aforementioned, the conventional gate system is not always able to correctly sort the coins being fed continuously since the gate has to be operated with the exact timing. In addition, it is necessary to feed coins with a predetermined separation therebetween in order to sort the coins correctly.

SUMMARY OF THE INVENTION

It is therefore the object of the invention to provide a coin sorting apparatus which is capable of sorting coins exactly without coin jammings even if coins are fed continuously.

According to the present invention, the above and other objects can be accomplished by a coin sorting apparatus comprising: coin sending out means for receiving a plurality of various kinds of coins and sending out the coins one by one therefrom; a coin guideway extending from the coin sending out means; a coin feeding belt for pressing the coins sent out from the coin sending out means against the guideway to feed the coins; coin identifying means for grouping the coins fed by the feeding belt into a first and a second group in accordance with the face values of the coins, whereby the coins are sorted into each kind in accordance with the identification of the coin identifying device, characterized by: a sort-out opening formed on a surface of the coin guideway downstream from the coin identifying means; a rotor having an axis about which the rotor is rotatable, said rotor having a larger diameter portion having elevation equal to or slightly higher than the coin guideway and a smaller diameter portion having elevation lower than the coin guideway, said axis lying substantially beneath the center of the sort-out opening and under the coin guideway, said axis parallel to the coin guideway and normal to the coin feeding direction; and control means for controlling the rotation of the rotor so that the larger diameter portion of the rotor aligns with the coin guideway when coins in the first group are fed to the sort-out opening and the smaller diameter portion of the rotor forms a gap between the rotor and the coin guideway when coins in the second group are fed to the sort-out opening.

When the larger diameter portion of the rotor aligns with the coin guideway, coins are fed from the upstream coin guideway to the downstream coin guideway over the larger diameter portion of the rotor. When the smaller diameter portion of the rotor forms a gap between the downstream coin guideway and the smaller diameter portion, coins fed from the upstream coin guideway slide down into the sort-out opening over the smaller diameter portion. The coins are separated into two groups by controlling the rotation of the rotor in accordance with the identification by the coin identifying device. The coins belonging to the first group are to pass over the sort-out opening while coins belonging to the second group are to fall into the sort-out opening.

The above and other objects and advantageous features of the present invention will be made apparent from the following description made with reference to the accompanying drawings.

BRIEF DESCRIPTION OF THE DRAWINGS

FIG. 3 is an example of a control table according to which a rotor is controlled.

DESCRIPTION OF PREFERRED EMBODIMENTS

Figure 1:
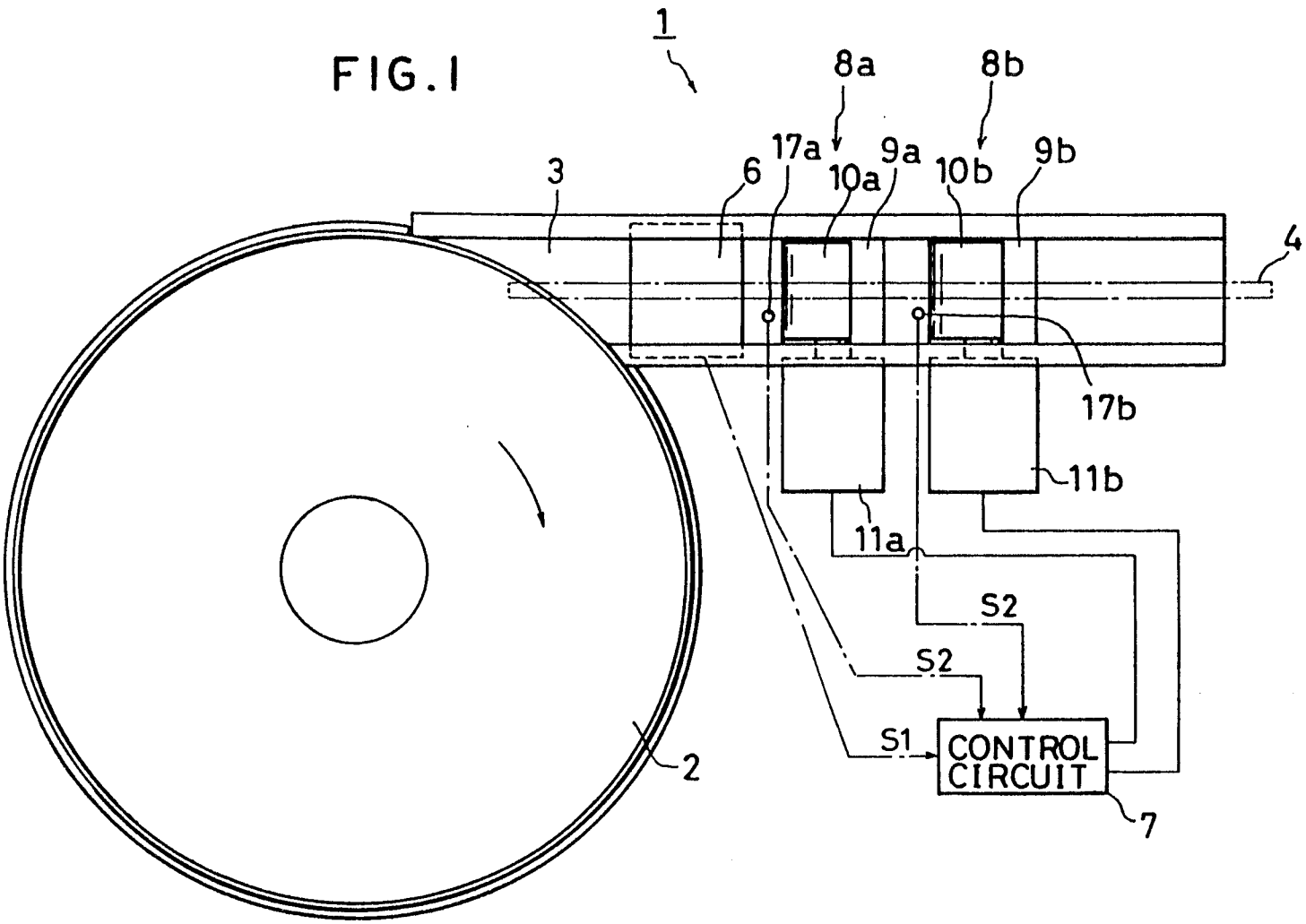
FIG. 1 is a top plan view of a coin sorting apparatus in accordance with the invention.
Figure 2:
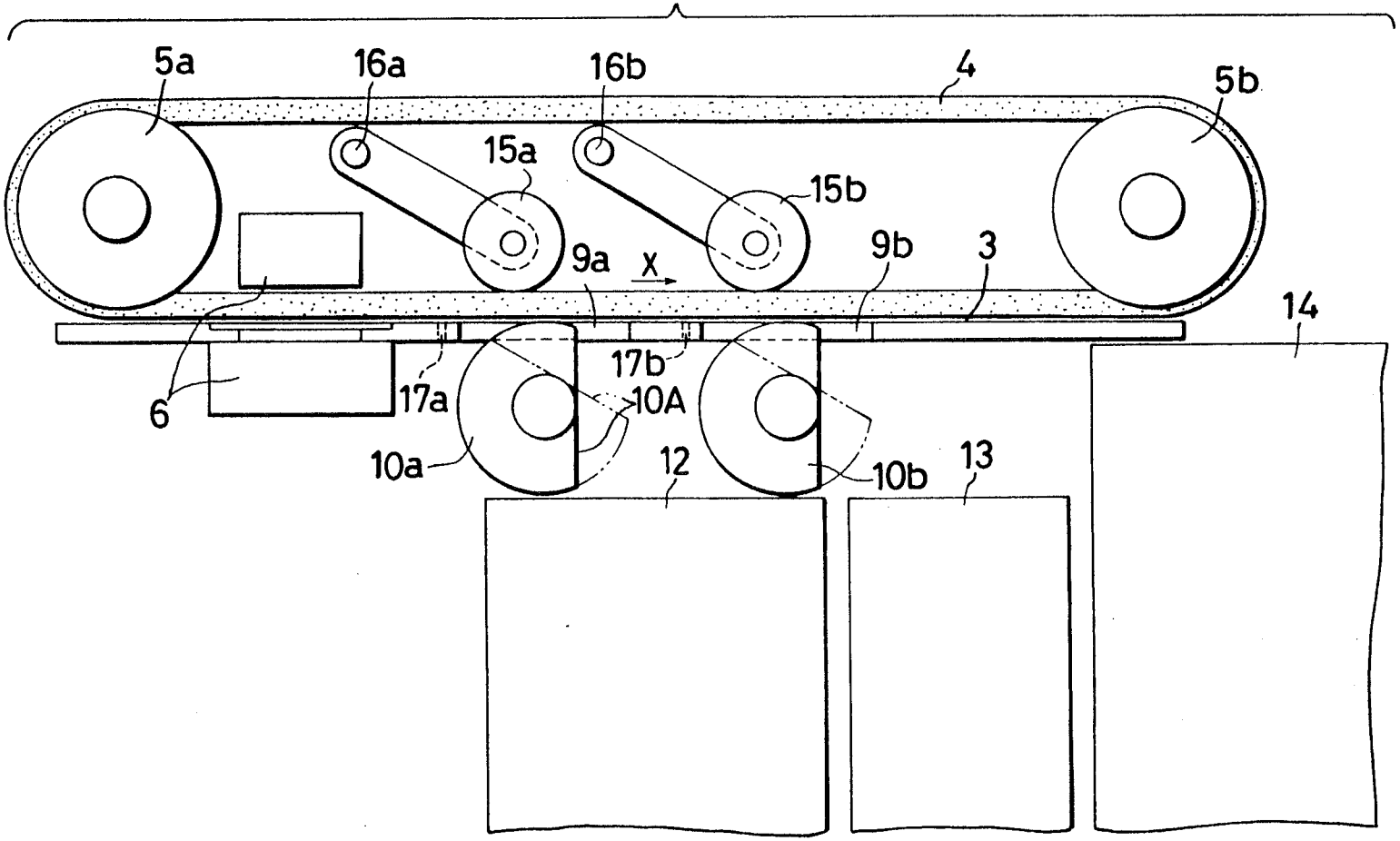
FIG. 2 is a side elevational view of the coin sorting apparatus shown in FIG. 1.

Referring to FIGS. 1 and 2, a coin sorting apparatus 1 comprises a rotary disk 2 capable of rotating in the clockwise direction. The rotary disk 2 receives thereon a plurality of coins with various face values. When the rotary disk 2 rotates, the centrifugal force acts on the coins disposed on the disk 2 tangentially to the rotary disk 2. The coins disposed on the disk 2 are sent out one by one due to the centrifugal force to a coin guideway 3 which extends tangentially to the rotary disk 2. A belt 4 for feeding the coins is disposed above and parallel to the coin guideway 3. The belt 4 is wound around a pair of feed rollers **5*a* and 5*b* to be driven toward the direction indicated by an arrow X shown in FIG. 2. The coin feeding belt 4 compresses a coin sent out from the rotary disk 2 against the coin guideway 3 to feed the coin on the coin guideway 3** in the direction X.

A coin identifying device 6 is provided within a loop formed by the coin feeding belt 4. The coin identifying device 6 detects outer diameters and/or alloys of the coins fed by the feeding belt 4 to determine the face value of the coins and transmits a identification signal S1 to a control circuit 7. As shown in FIG. 3, the control circuit 7 receives the identification signals S1 and assembles a first signal array comprising the identification signals S1 in the order according to which the signals S1 were received. This array is stored in the control circuit 7.

Two coin sorting units **8*a* and 8*b* are provided in series in the coin feeding direction at the downstream of the coin identifying device 6. Since the two units 8*a* and 8*b* have the same structure, only the unit 8*a* is explained hereinafter. The coin sorting unit 8*a* includes a sort-out opening 9*a*, a rotor 10*a* and a rotary solenoid 11*a*. The sort-out opening 9*a* is formed on the surface of the coin guideway and is rectangular. The rotor 10*a* is disposed under the sort-out opening 9*a* so that a point on the axis about which the rotor 10*a* is able to rotate lies substantially beneath the center of the opening 9*a*. As shown in FIG. 2, the rotor 10*a* is formed in the shape of a circular roller partially cut off to have a plane portion 10A. This rotor 10*a* is arranged to be rotatable about an axis which is parallel to the coin guideway 3 and normal to the coin feeding direction. The rotor 10*a* is secured to the rotary solenoid 11*a* and is driven to rotate by the rotary solenoid 11*a*. The rotary solenoid 11*a* is able to rotate by 60 degrees. For instance, the solenoid 11*a* rotates by 60 degrees in the clockwise direction and stops there on receiving a positive signal while it rotates by 60 degrees in the counterclockwise direction and stops there on receiving a negative signal. Thus, the rotor 10*a* is able to take two positions, that is a first position shown in solid line and a second position shown in broken line as shown in FIG. 2. In the first position, the circumference of the rotor 10***a* is arranged to be the same elevation as the coin guideway 3 or slightly higher than the coin guideway 3. In the second position, the plane portion 10A of the rotor 10*a* forms a declination from the coin guideway 3 with respect to the direction along which coins are fed. In other words, in the second position of the rotor 10*a*, the plane portion 10A of the rotor 10*a* extends straight toward the lower right from the upstream end of the sort-out opening 9*a*. The rotary solenoid 11*a* is controlled to rotate either in the clockwise or in the counterclockwise direction by the control circuit 7.

First and second coin reservoirs 12 and 13 are provided below the rotors 10*a* and 10*b* respectively to receive coins which slide down thereinto along the plane portion 10A forming a declination. In addition, a third coin reservoir 14 is provided below the feed roller 5*b* to receive coins fed by the feeding belt 4.

Press rollers 15*a* and 15*b* are disposed above the sort-out openings 9*a* and 9*b* respectively. The press rollers 15*a* and 15*b* have the same structure. The press rollers 15*a* and 15*b* are arranged to be pivotable about axes 16*a* and 16*b* which are parallel to the coin guideway 3 and normal to the coin feeding direction. In normal position, the rollers 15*a* and 15*b* are biased downward by springs (not shown) to press the coin feeding belt 4.

Coin detecting sensors 17*a* and 17*b* are embedded in the coin guideway 3 at the upstream from the sort-out openings 9*a* and 9*b*. These sensors 17*a* and 17*b* transmit a detection signal S2 to the control circuit 7 each time a coin fed by the feeding belt 4 covers sensor 17*a* or 17*b*. The control circuit 7 assembles a second signal array comprising the received detection signals S2 and stores the second array therein.

The mode of operation of the aforementioned coin sorting apparatus 1 will be described hereinbelow.

The coin identifying device 6 identifies the face values of the coins sent out from the rotary disk 2 and tranamits the identification signal S1 to the control circuit 7 in accordance with the face value of the coin. The control circuit 7 assembles the first signal array consisting of the signals S1 as shown in FIG. 3. The coin detecting sensor 17*a* transmits the detection signal S2 to the control circuit 7 each time a coin is fed to pass on the sensor 17*a*. The control circuit 7 assembles the second signal array consisting of the signals S2.

In this embodiment, the coin sorting unit 8*a*, disposed upstream from the coin sorting unit 8*b* with respect to the coin feeding direction, is used to separate out foreign and/or counterfeit coins, while the unit 8*b* is used to separate out Japanese 100 yen coins. (It should be noted that Japanese hard currency includes six kinds of coin, that is 1 yen, 5 yen, 10 yen, 50 yen, 100 yen and 500 yen coins.)

With reference to FIG. 3, suppose that a third coin fed is a foreign one. At first, the control circuit 7 compares the first signal array, which has been already established, consisting of the signals S1 delivered from the coin identifying device 6 with the second signal array. Then, when a third coin detection signal is assembled into the second signal array, the control circuit 7 drives the rotary solenoid 11*a* so that the rotor 10*a* of the coin sorting unit 8*a* pivots to the second position. Accordingly, the foreign coin then falls into the first coin reservoir 12. When Japanese coins are fed, the control circuit 7 drives the rotor 10*a* of the unit 8*a* not to rotate but to stay in its first position, so that the coins pass the coin sorting unit 8*b* unit 8*a* and advance to the second coin sorting When the coin fed by the feeding belt 4 passes the coin detecting sensor 17*b*, the sensor 17*b* delivers the detection signal S2 to the control circuit 7. The control circuit 7 assembles the second signal array to compare with the first signal array which has already been assembled. If the control circuit 7 determines from the comparison that the fed coin is 100 yen coin, the circuit 7 drives the rotary solenoid 11*b* so that the rotor 10*b* pivots to the second position. If the circuit 7 determines by the comparison that the fed coin is other than 100 yen coin, the control circuit 7 drives the rotary solenoid so that the rotor 10*b* pivots to the first position.

The coin sorting units 8*a* and 8*b* are operated as aforementioned, resulting in that foreign and/or counterfeit coins are introduced into the first coin reservoir 12, Japanese 100 yen coins are introduced into the second reservoir 13 and Japanese coins other than 100 yen coins are introduced into the third coin reservoir 14. Thus, desired separation of coins is able to be performed, that is only 100 yen coins are separated out of coins with various face values.

Figure 4A:
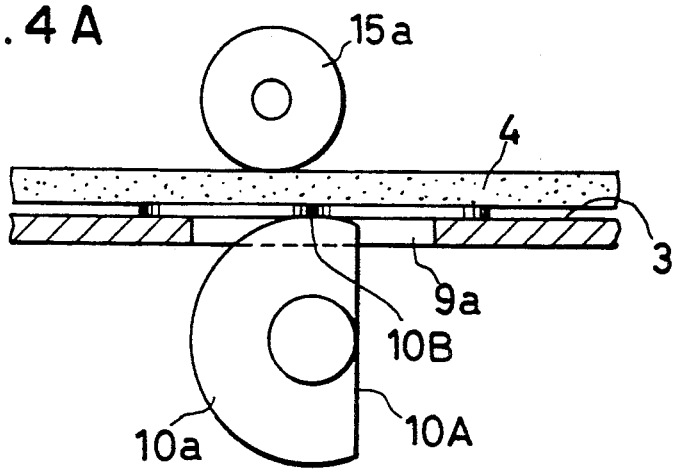
FIGS. 4A to 4C are cross sectional views illustrating positional relationships between a rotating rotor and a coin being fed.
Figure 4B:
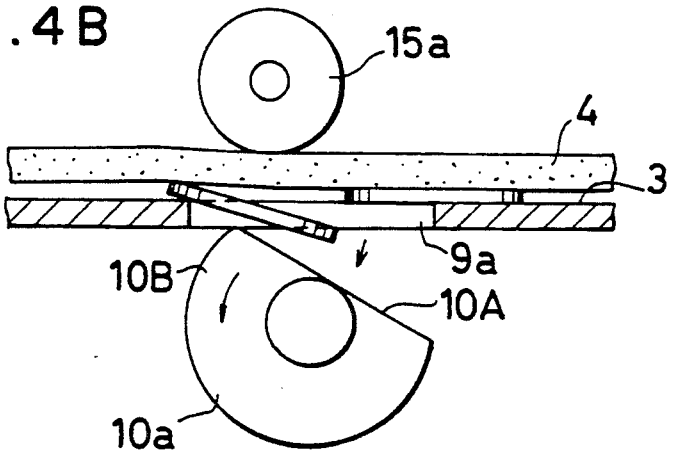
Figure 4C:
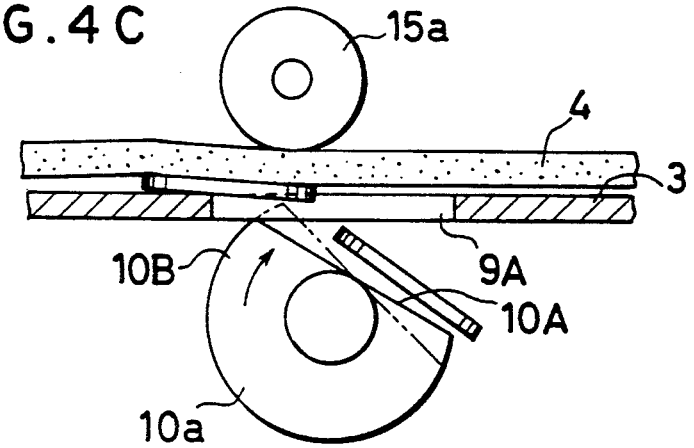

With reference to FIGS. 4A to 4C, how coins pass over the rotors 10*a* and 10*b* and how coins fall into the first and second reservoirs 12 and 13 is explained hereinafter. FIG. 4A shows the case in which two coins continuously fed are not to fall into the reservoir but are to pass over the sort-out opening 9*a*. When a coin passes over the rotor 10*a* disposed in the first position, the press force acting on the rear end of the coin, due to the pressure of the feeding belt 4, overcomes the force of gravity which attempts to drop the coin into the reservoir before most of the surface of the coin reaches the sort-out opening 9*a*. Accordingly, the coin is fed toward the downstream with respect to the coin feeding direction on the coin guideway 3 with the forward portion of the coin being kept substantially parallel to the coin guideway 3.

When most of the surface of the coin reaches on the sort-out opening 9*a*, the force of gravity which attempts to drop the coin into the reservoir overcomes the press force produced by the feeding belt 4 acting on the rear end of the coin. Accordingly, the forward portion of the coin would fall down. However, before that, the forward portion of the coin gets on a larger diameter portion 10B of the rotor 10*a*, so that the coin is kept substantially parallel to the coin guideway 3 and can be fed toward the downstream with respect to the coin feeding direction.

When the coin leaves the coin guideway 3 and gets on only the larger diameter portion 10B of the rotor 10*a*, the press force acts on the top surface of the coin equally. Therefore, the coin is kept substantially parallel to the coin guideway 3 and is fed further toward the downstream in the coin feeding direction.

Furthermore, before the coin comes to be supported at its rear portion by the larger diameter portion 10B of the rotor 10*a*, the forward portion of the coin passes over the sort-out opening 9*a* and reaches the coin guideway 3. Thus, the coin can be fed on the coin guideway 3 over the sort-out opening 9*a*.

In addition, when the coin is transferring onto the larger diameter portion 10B of the rotor 10*a*, the coin can do so smoothly since the larger diameter portion 10B is in the form of an arc.

FIG. 4B shows the case in which, among two coins which are continuously fed, a first fed coin is intended to pass over the sort-out opening 9a without being dropped into the first coin reservoir 12 and a following fed coin is intended to fall into the reservoir 12. After the first fed coin passes the larger diameter portion 10B of the rotor 10a and reaches the coin guideway 3 disposed downstream in the coin feeding direction, the press force due to the feeding belt 4 overcomes the force of gravity on the coin. Therefore, even if the rotor 10a is controlled slightly too early to start pivotting in the counterclockwise direction, the first fed coin continues to be fed without falling into the sort-out opening 9a. Only the following fed coin falls into the sort-out opening 9a.

On the other hand, even if the rotor 10a is driven slightly too late to pivot from the first position to the second position, since most of the following fed coin has already reached the sort-out opening 9a, the following fed coin immediately slides down into the sort-out opening 9aalong the surface of the plane portion 10A when the rotor 10a pivots. Thus, the first and following fed coins do not cause coin jamming.

FIG. 4C shows the case in which, among two coins which are continuously fed, a first fed coin is intended to fall into the sort-out opening 9a and a following fed coin is intended to pass over the sort-out opening 9a without falling into the first coin reservoir 12. Suppose that the rotor 10a is operated to pivot from the second position to the first position in order to pass the following fed coin over the larger diameter portion 10B of the rotor 10a. In this case, since the pivotal movement of the rotor 10a in the clockwise direction increases the declination which the larger diameter portion 10B forms, the first fed coin is further forced to slide down along the surface of the larger diameter portion 10B. Thus, even if the rotor 10a is driven to pivot slightly too early, the rear portion of the first fed coin is able to avoid to be clamped between the larger diameter portion 10B of the rotor 10a and the sort-out opening 9a.

On the other hand, even if the rotor 10a is operated slightly too late to pivot from the second position to the first position, the following fed coin is able to pass over the sort-out opening 9a without falling into the opening 9a and get on the coin guideway 3. This is because when the larger diameter portion 10B contacts with the forward portion or middle portion of the following fed coin, the two forces, which both lift up forward portion of the following fed coin, are combined with each other to support the following fed coin, wherein one force is generated due to the pivotal movement of the rotor 10a and the other force is generated, on the basis of the principle of the lever and fulcrum, because the rear portion of the following fed coin is pressed by the coin feeding belt 4.

In addition, when the rotors 10a and 10b are disposed in their second positions, coins fed are forced to turn downward by the press rollers 15a and 15b earlier than the coins would turn downward due to the force of gravity thereon. Thus, the coins are introduced into the sort-out openings 9a and 9b without fail. On the other hand, when the rotors 10a and 10b are disposed in their first positions, the forward portion of the coins fed is going to be pushed up on the basis of the principle of the lever and fulcrum since the feeding belt 4 and the press rollers 15a and 15b press the rear portion of the coin. Thus, the coin is able to be fed on the coin guideway 3 without falling into the sort out openings 9a and 9b.

Figure 5:
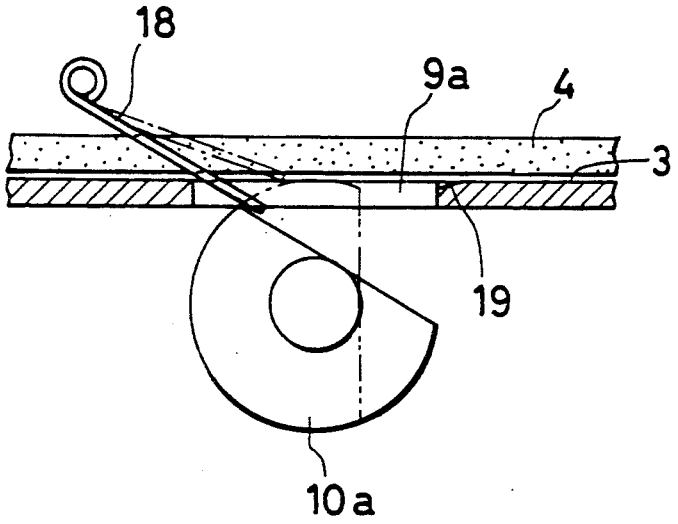
FIG. 5 is a side elevational view of an example of the pressing means.

A strip 18 shown in FIG. 5 is used in place of the press rollers 15a and 15b. The strip 18 is normally biased downward by a spring (not shown) to give directly a pressure to coins fed to introduce the coins into the sort-out opening 9a. Alternatively, the strip 18 may comprise a spiral spring providing downward biasing force instead of the combination of the strip and the spring.

As shown in FIG. 5, the coin guideway 3 may be provided with a chamfer 19 at the downstream edge of the sort-out openings 9a and 9b. The chamfer 19 allows the smooth passage of coins between the rotors 10a and 10b and the coin guideway 3.

The coin sorting apparatus 1 in accordance with the invention is applicable to an apparatus for sorting a plurality of coins including various kinds of coins into each kind of coin by arranging a plurality of the coin sorting apparatus 1 in series in the coin feeding direction. Generally, in order to sort N kinds of coins into each kind, (N−1) apparatuses are necessary to do so. For instance, in order to sort Japanese hard currency which includes six kinds of coins, that is 1 yen, 5 yen, 10 yen, 50 yen, 100 yen and 500 yen, into each kind of coin, five coin sorting apparatuses is necessary.

In the aforementioned example, the same number of coin sorting apparatuses as that of kinds of domestic coins, or six coin sorting apparatuses, are necessary to separate out foreign and/or counterfeit coins.

In this arrangement, the first coin sorting apparatus is preferably used to remove foreign and/or counterfeit coins. If foreign or counterfeit coins are intended to be removed through a sort-out opening of the second apparatus or subsequent apparatuses, it causes the incorrect sort in the case that some of the foreign and/or counterfeit coins have such a small diameter as not to be able to straddle between the rotor and the coin guideway.

As aforementioned with respect to the preferred embodiment, in accordance with the present invention, it is possible to correctly sort coins without coin jammings of the first fed coin and the following fed coins at the sort-out opening, even if coins are fed continuously and are sorted by falling into and passing over the sort-out opening.

While the invention has been described in connection with preferred embodiments, it will be understood that it is not intended to limit the invention to those embodiments. On the contrary, it is intended that the invention cover all alternatives, modifications and equivalents as may be included within the spirit and scope of the invention as defined by the attached claims.

What is claimed is:

1. A coin sorting apparatus comprising:

coin sending out means for receiving a plurality of various kinds of coins and sending out the coins one by one therefrom;

a coin guideway extending from the coin sending out means;

a coin feeding belt for pressing the coins sent out from the coin sending out means against the guideway to feed the coins;

coin identifying means for grouping the coins fed by the feeding belt into a first and a second group in accordance with the face values of the coins, whereby the coins are sorted into each kind in accordance with the identification of the coin identifying device, characterized by:

a sort-out opening formed on a surface of the coin guideway downstream from the coin identifying means;

a rotor having an axis about which the rotor is rotatable, said rotor having a larger diameter portion having elevation equal to or slightly higher than the coin guideway and a smaller diameter portion having elevation lower than the coin guideway, said axis lying substantially beneath the center of the sort-out opening and under the coin guideway, said axis parallel to the coin guideway and normal to the coin feeding direction; and control means for controlling the rotation of the rotor so that the larger diameter portion of the rotor aligns with the coin guideway when coins belonging to the first group are fed to the sort-out opening and the smaller diameter portion of the rotor forms a gap between the rotor and the coin guideway when coins belonging to the second group are fed to the sort-out opening.

2. A coin sorting apparatus in accordance with claim 1, wherein said rotor comprises a cylindrical roller having a plane portion formed parallel to the axis of the roller by partially cutting off the cylindrical surface of the roller, and wherein said control means controls the rotor so that an arc portion of the rotor aligns with the coin guideway when coins belonging to the first group are fed to the sort-out opening and the plane portion of the rotor extends aslant downwardly from the upstream end of the sort-out opening in the downstream direction when coins belonging to the second group are fed to the sort-out opening.

3. A coin sorting apparatus in accordance with claim 1, wherein a chamfer is provided on an upper edge of the sort-out opening, said edge disposed downstream in the coin feeding direction.

4. A coin sorting apparatus in accordance with claim 2, wherein a chamfer is provided on an upper edge of the sort-out opening, said edge disposed downstream in the coin feeding direction.

5. A coin sorting apparatus in accordance with claim 1, wherein coin pressing means is further provided for pressing coins, fed by the coin feeding belt, against the sort-out opening upstream from said axis.

6. A coin sorting apparatus in accordance with claim 2, wherein coin pressing means is further provided for pressing coins, fed by the coin feeding belt, against the sort-out opening upstream from said axis.

7. A coin sorting apparatus in accordance with claim 5, wherein said coin pressing means comprises: a strip pivotable up and down about an axis disposed above the coin guideway, said axis being in a plane parallel to the coin guideway and normal to the coin feeding direction; and biasing means for biasing said strip downward.

8. A coin sorting apparatus in accordance with claim 5, wherein said coin pressing means comprises: a roller pivotable up and down about an axis disposed above the coin guideway, said axis being in a plane parallel to the coin guideway and normal to the coin feeding direction; and biasing means for biasing said roller downward against the coin feeding belt.

9. A coin sorting apparatus comprising:

coin sending out means for receiving a plurality of various kinds of coins and sending out the coins one by one therefrom;

a coin guideway extending from the coin sending out means;

a coin feeding belt for pressing the coins sent out from the coin sending out means against the guideway to feed the coins;

coin identifying means for grouping the coins fed by the feeding belt into a first and a second group in accordance with the face values of the coins, whereby the coins are sorted into each kind in accordance with the identification of the coin identifying device, characterized by:

a plurality of a coin sorting unit disposed in series along the coin feeding direction, said coin sorting unit comprising:

a sort-out opening formed on a surface of the coin guideway downstream from the coin identifying means;

a rotor having an axis about which the rotor is rotatable, said rotor having a larger diameter portion having elevation equal to or slightly higher than the coin guideway and a smaller diameter portion having elevation lower than the coin guideway, said axis lying substantially beneath the center of the sort-out opening and under the coin guideway, said axis parallel to the coin guideway and normal to the coin feeding direction; and control means for controlling the rotation of the rotor so that the larger diameter portion of the rotor aligns with the coin guideway when coins belonging to the first group are fed to the sort-out opening and the smaller diameter portion of the rotor forms a gap between the rotor and the coin guideway when coins belonging to the second group are fed to the sort-out opening.

10. A coin sorting apparatus in accordance with claim 9, wherein the coin sorting units are provided by the number smaller by one than the number of the kinds of coins to be sorted by the coin sorting apparatus.

11. A coin sorting apparatus in accordance with claim 9, wherein the first coin sorting unit is arranged to remove foreign and/or counterfeit coins.

12. A coin sorting apparatus in accordance with claim 9, wherein the coin sorting units are provided by the number equal to the number of the kinds of coins to be sorted by the coin sorting apparatus and the first coin sorting unit is arranged to remove foreign and/or counterfeit coins.

13. A coin sorting apparatus in accordance with claim 9, wherein said rotor comprises a cylindrical roller having a plane portion formed parallel to the axis of the roller by partially cutting off the cylindrical surface of the roller, and wherein said control means controls the rotor so that an arc portion of the rotor aligns with the coin guideway when coins belonging to the first group are fed to the sort-out opening and the plane portion of the rotor extends aslant downwardly from the upstream end of the sort-out opening in the downstream direction when coins belonging to the second group are fed to the sort-out opening.

14. A coin sorting apparatus in accordance with claim 10, wherein said rotor comprises a cylindrical roller having a plane portion formed parallel to the axis of the roller by partially cutting off the cylindrical surface of the roller, and wherein said control means controls the rotor so that an arc portion of the rotor aligns with the coin guideway when coins belonging to the first group are fed to the sort-out opening and the plane portion of the rotor extends aslant downwardly from the upstream end of the sort-out opening in the downstream direction when coins belonging to the second group are fed to the sort-out opening.

15. A coin sorting apparatus in accordance with claim 11, wherein said rotor comprises a cylindrical roller having a plane portion formed parallel to the axis of the roller by partially cutting off the cylindrical surface of the roller, and wherein said control means controls the rotor so that an arc portion of the rotor aligns with the coin guideway when coins belonging to the first group are fed to the sort-out opening and the plane portion of the rotor extends aslant downwardly from the upstream end of the sort-out opening in the downstream direction when coins belonging to the second group are fed to the sort-out opening.

16. A coin sorting apparatus in accordance with claim 12, wherein said rotor comprises a cylindrical roller having a plane portion formed parallel to the axis of the roller by partially cutting off the cylindrical surface of the roller, and wherein said control means controls the rotor so that an arc portion of the rotor aligns with the coin guideway when coins belonging to the first group are fed to the sort-out opening and the plane portion of the rotor extends aslant downwardly from the upstream end of the sort-out opening in the downstream direction when coins belonging to the second group are fed to the sort-out opening.

17. A coin sorting apparatus in accordance with claim 9, wherein a chamfer is provided on an upper edge of the sort-out opening, said edge disposed downstream in the coin feeding direction.

18. A coin sorting apparatus in accordance with claim 9, wherein coin pressing means is further provided for pressing coins, fed by the coin feeding belt, against the sort-out opening upstream from said axis.

19. A coin sorting apparatus in accordance with claim 18, wherein said coin pressing means comprises: a strip pivotable up and down about an axis disposed above the coin guideway, said axis being in a plane parallel to the coin guideway and normal to the coin feeding direction; and biasing means for biasing said strip downward.

20. A coin sorting apparatus in accordance with claim 18, wherein said coin pressing means comprises: a roller pivotable up and down about an axis disposed above the coin guideway, said axis being in a plane parallel to the coin guideway and normal to the coin feeding direction; and biasing means for biasing said roller downward against the coin feeding belt.

* * * * *